US010539010B2

(12) United States Patent
Gutierrez et al.

(10) Patent No.: US 10,539,010 B2
(45) Date of Patent: Jan. 21, 2020

(54) SUBSEA PROCESSOR FOR UNDERWATER DRILLING OPERATIONS

(71) Applicant: Transocean Innovation Labs Ltd., Grand Cayman, Cayman Islands (KY)

(72) Inventors: Jose Gutierrez, Houston, TX (US); Luis Pereira, Houston, TX (US)

(73) Assignee: Transocean Innovation Labs Ltd., Grand Cayman (KY)

( * ) Notice: Subject to any disclaimer, the term of this patent is extended or adjusted under 35 U.S.C. 154(b) by 0 days.

(21) Appl. No.: 14/055,669

(22) Filed: Oct. 16, 2013

(65) Prior Publication Data

US 2014/0102712 A1 Apr. 17, 2014

Related U.S. Application Data

(60) Provisional application No. 61/715,113, filed on Oct. 17, 2012, provisional application No. 61/718,061, filed on Oct. 24, 2012, provisional application No. 61/883,623, filed on Sep. 27, 2013.

(51) Int. Cl.

| | |
|---|---|
| ***E21B 47/12*** | (2012.01) |
| ***E21B 33/064*** | (2006.01) |
| ***E21B 7/12*** | (2006.01) |
| ***E21B 33/06*** | (2006.01) |

(52) U.S. Cl.

CPC ..... *E21B 47/122* (2013.01); *E21B 7/12* (2013.01); *E21B 33/063* (2013.01); *E21B 33/064* (2013.01)

(58) Field of Classification Search

CPC ..... E21B 47/00; E21B 47/0001; E21B 47/12; E21B 47/122; E21B 47/124

USPC ..... 166/363, 364, 250.01

See application file for complete search history.

(56) References Cited

U.S. PATENT DOCUMENTS

| | | | |
|---|---|---|---|
| 4,081,611 | A | 3/1978 | Bovo et al. |
| 4,663,704 | A | 5/1987 | Jones et al. |
| 4,707,041 | A | 11/1987 | Kovit et al. |
| 4,876,742 | A | 10/1989 | Vacon et al. |

(Continued)

FOREIGN PATENT DOCUMENTS

| | | |
|---|---|---|
| CN | 101446191 | 6/2009 |
| CN | 102168547 | 8/2011 |

(Continued)

OTHER PUBLICATIONS

Office Action issued in Chinese Patent Application No. 201380066218.0, dated Apr. 28, 2018.

(Continued)

*Primary Examiner* — Anna M Momper
*Assistant Examiner* — Patrick F Lambe

(57) ABSTRACT

A subsea processor may be located near the seabed of a drilling site and used to coordinate operations of underwater drilling components. The subsea processor may be enclosed in a single interchangeable unit that fits a receptor on an underwater drilling component, such as a blow-out preventer (BOP). The subsea processor may issue commands to control the BOP and receive measurements from sensors located throughout the BOP. The subsea processor may relay information to the surface for recording or monitoring. The subsea processor may also be programmed with a model from which to base operation of the BOP, such as in emergency conditions.

22 Claims, 11 Drawing Sheets

(56) References Cited

U.S. PATENT DOCUMENTS

| | | | | |
|---|---|---|---|---|
| 4,922,423 | A | 5/1990 | Koomey et al. | |
| 5,295,547 | A | 3/1994 | Coelho et al. | |
| 5,407,172 | A | 4/1995 | Young et al. | |
| 5,579,368 | A | 11/1996 | van Berkum | |
| 5,677,909 | A | 10/1997 | Heide | |
| 5,838,732 | A | 11/1998 | Carney | |
| 5,875,174 | A | 2/1999 | Okazaki | |
| 6,484,806 | B2 | 11/2002 | Childers et al. | |
| 6,597,683 | B1 | 7/2003 | Gehring et al. | |
| 6,755,261 | B2 | 6/2004 | Koederitz | |
| 6,967,937 | B1 | 11/2005 | Gormley | |
| 7,155,161 | B2 | 12/2006 | Regulinski et al. | |
| 7,248,178 | B2 | 7/2007 | Layton | |
| 7,274,989 | B2 | 9/2007 | Hopper | |
| 7,447,761 | B1 | 11/2008 | Ferguson et al. | |
| 7,510,449 | B2 | 3/2009 | Ito et al. | |
| 7,696,900 | B2 | 4/2010 | Hall et al. | |
| 7,775,275 | B2 | 8/2010 | Patel | |
| 7,832,706 | B2 | 11/2010 | Judge | |
| 8,074,720 | B2 * | 12/2011 | Radi | 166/350 |
| 8,149,133 | B2 | 4/2012 | Milne | |
| 8,536,731 | B2 | 9/2013 | Biester et al. | |
| 9,202,175 | B2 | 12/2015 | Al-Yami et al. | |
| 9,322,264 | B2 | 4/2016 | Gutierrez et al. | |
| 2001/0052427 | A1 | 12/2001 | Eppink et al. | |
| 2003/0006070 | A1 | 1/2003 | Dean | |
| 2003/0098799 | A1 | 5/2003 | Zimmerman | |
| 2004/0000121 | A1 | 1/2004 | Ichikawa et al. | |
| 2004/0008719 | A1 | 1/2004 | Ying | |
| 2004/0040707 | A1 | 3/2004 | Dusterhoft et al. | |
| 2004/0043777 | A1 | 3/2004 | Brouwer et al. | |
| 2005/0194182 | A1 | 9/2005 | Rodney et al. | |
| 2005/0274513 | A1 | 12/2005 | Schultz et al. | |
| 2006/0077945 | A1 | 4/2006 | KethiReddy et al. | |
| 2007/0077884 | A1 | 4/2007 | Regulinski et al. | |
| 2007/0168086 | A1 | 7/2007 | Schultz | |
| 2007/0268908 | A1 | 11/2007 | Linkola et al. | |
| 2008/0099197 | A1 | 5/2008 | Payne | |
| 2008/0128138 | A1 | 6/2008 | Radi | |
| 2008/0135291 | A1 | 6/2008 | Hall et al. | |
| 2009/0194290 | A1 | 8/2009 | Parks et al. | |
| 2009/0212969 | A1 | 8/2009 | Voss | |
| 2009/0265395 | A1 | 10/2009 | Milne | |
| 2009/0287414 | A1 | 11/2009 | Vickery | |
| 2009/0288835 | A1 * | 11/2009 | Sbordone | 166/336 |
| 2010/0019573 | A1 | 1/2010 | Biester et al. | |
| 2010/0133004 | A1 | 6/2010 | Burleson et al. | |
| 2010/0145479 | A1 | 6/2010 | Griffiths | |
| 2010/0227551 | A1 | 9/2010 | Volanthen et al. | |
| 2011/0226475 | A1 | 9/2011 | Springett et al. | |
| 2011/0285201 | A1 | 11/2011 | Peuser | |
| 2012/0000646 | A1 | 1/2012 | Liotta et al. | |
| 2012/0032523 | A1 | 2/2012 | Overton et al. | |
| 2012/0037375 | A1 | 2/2012 | Reynolds et al. | |
| 2012/0097383 | A1 * | 4/2012 | Fenton | E21B 33/0385 166/65.1 |
| 2012/0112924 | A1 | 5/2012 | Mackay et al. | |
| 2012/0152554 | A1 | 6/2012 | Milne | |
| 2012/0175969 | A1 | 7/2012 | Maughan et al. | |
| 2012/0211234 | A1 | 8/2012 | Wilie et al. | |
| 2012/0217017 | A1 | 8/2012 | Zediker | |
| 2012/0221308 | A1 | 8/2012 | Chen | |
| 2012/0256634 | A1 | 10/2012 | Morys | |
| 2012/0292107 | A1 | 11/2012 | Orbell et al. | |
| 2013/0088362 | A1 | 4/2013 | Yates et al. | |
| 2013/0118755 | A1 | 5/2013 | Kotrla et al. | |
| 2013/0153241 | A1 | 6/2013 | Mallinson et al. | |
| 2013/0173073 | A1 | 7/2013 | Breeze et al. | |
| 2013/0223840 | A1 | 8/2013 | Chang | |
| 2013/0269945 | A1 * | 10/2013 | Mulholland | E21B 47/0001 166/336 |
| 2014/0064029 | A1 | 3/2014 | Jaffrey | |
| 2014/0102713 | A1 | 4/2014 | Gutierrez et al. | |
| 2014/0124265 | A1 | 5/2014 | Al-Yami et al. | |
| 2014/0129506 | A1 | 5/2014 | Al-Yami et al. | |
| 2014/0231075 | A1 | 8/2014 | Springett et al. | |
| 2014/0368202 | A1 | 12/2014 | San Martin et al. | |
| 2015/0094866 | A1 | 4/2015 | Pereira et al. | |

FOREIGN PATENT DOCUMENTS

| | | |
|---|---|---|
| CN | 102561979 | 7/2012 |
| EP | 2194227 | 6/2010 |
| GB | 2458944 | 10/2009 |
| JP | 64-046844 | 2/1989 |
| JP | 01-136587 | 5/1989 |
| JP | 04-195639 | 7/1992 |
| JP | 07-110788 | 4/1995 |
| JP | 10-111768 | 4/1998 |
| JP | 2002-531000 | 9/2002 |
| JP | 2005-020113 | 1/2005 |
| JP | 2005-513958 | 5/2005 |
| JP | 2005-517278 | 6/2005 |
| JP | 2007-034415 | 2/2007 |
| JP | 2008-547024 | 12/2008 |
| JP | 2009-215944 | 9/2009 |
| WO | WO 2005/111484 | 11/2005 |
| WO | WO 2007/027080 | 3/2007 |
| WO | WO 2012/018322 | 2/2012 |
| WO | WO 2012/037173 | 3/2012 |
| WO | WO 2012/077088 | 6/2012 |
| WO | WO 2012/113757 | 8/2012 |
| WO | WO 2014/062858 | 4/2014 |
| WO | WO 2015/048592 | 4/2015 |

OTHER PUBLICATIONS

Che et al., "TDMA frame design for a prototype underwater RF communication network," *Ad Hoc Networks*, 10:317-327, (2012).

Chitre et al., "Underwater acoustic Communications and Networking: Recent Advances and Future Challenges," *Marine Technology Society Journal*, 42(1):103-116, (2008).

International Search Report and Written Opinion issued in International Patent Application No. PCT/US2014/057925, dated Mar. 2, 2015.

International Search Report and Written Opinion issued in International Patent Application No. PCT/US2013/065328, dated Mar. 11, 2014.

International Search Report and Written Opinion issued in International Patent Application No. PCT/US2013/065325, dated Mar. 6, 2014.

Office Action issued in Australian Patent Application No. 2013331312, dated Apr. 19, 2017.

Office Action issued in Australian Patent Application No. 2013331309, dated Nov. 28, 2016.

Office Action issued in Australian Patent Application No. 2014324610, dated Jan. 16, 2018.

Office Action issued in Chinese Application No. 201380066223.1 dated Jul. 18, 2017.

Office Action issued in Chinese Patent Application No. 201380066218.0, dated Jul. 13, 2017.

Office Action issued in Eurasian Patent Application No. 201590739, dated Oct. 20, 2016.

Office Action issued in Eurasian Patent Application No. 201590739, dated Jul. 21, 2017.

Office Action issued in Eurasian Patent Application No. 201590740, dated Oct. 20, 2016.

Office Action issued in Eurasian Patent Application No. 201590740, dated Jul. 19, 2017.

Office Action issued in Eurasian Patent Application No. 201690670, dated May 16, 2017.

Office Action issued in Eurasian Patent Application No. 201690670, dated Dec. 14, 2017.

Office Action issued in European Patent Application No. 13847526.4, dated Apr. 13, 2017.

Office action issued in European Patent Application No. 13847526.4, dated Apr. 12, 2018.

Office Action issued in Japanese Patent Application No. 2015-537806, dated May 23, 2017.

(56) References Cited

OTHER PUBLICATIONS

Office Action issued in Japanese Patent Application No. 2015-537806, dated Jan. 17, 2018.
Office Action issued in Japanese Patent Application No. 2015-537804, dated Jun. 7, 2017.
Office Action issued in Mexican Patent Application No. MX/a/2015/004943, dated Oct. 12, 2017.
Office Action issued in Mexican Patent application No. MX/a/2015/004944, dated Oct. 12, 2017.
Office Action issued in New Zealand Patent Application No. 708029, dated Feb. 28, 2017.
Office Action issued in New Zealand Patent Application No. 708037, dated Mar. 1, 2017.
Office Action issued in New Zealand Patent Application No. 708037, dated Oct. 19, 2017.
Supplementary European Search Report issued in European Patent Application No. 13847526.4, dated Jul. 6, 2016.
Supplementary European Search Report issued in European Patent Application No. 14848692, dated Oct. 6, 2017.
Supplementary European Search Report issued in European Patent Application No. 13846555, dated Sep. 12, 2016.
Written Opinion and Search Report issued in Singapore Patent Application No. 11201602237T, dated Jul. 17, 2017.
Written Opinion issued in Singapore Patent Application No. 11201503028U, dated Jun. 19, 2017.
Written Opinion issued in Singapore Patent Application No. 11201503029Y, dated Jan. 5, 2016.
Written Opinion issued in Singapore Patent Application No. 11201503029Y, dated Jul. 12, 2016.
Written Opinion Issued in Singapore Patent Application No. 11501503028U, dated Sep. 1, 2016.
First Office Action issued by the Chinese Patent Office for Application No. 201480065068.6, dated Jun. 4, 2018, 18 pages including English translation.
Office Action issued by the Japanese Patent Office for Application No. 2016-545258, dated Jul. 24, 2018, 16 pages including English translation.
Office Action issued for Eurasian Patent Application No. 201590740, dated Aug. 17, 2018, 2 pages—non-English.
Communication pursuant to Article 94(3) EPC issued by the European Patent Office for Application No. 13847526.4, dated Apr. 12, 2018, 8 pages.
Communication pursuant to Article 94(3) EPC issued by the European Patent Office for Application No. 13847526.4, dated Apr. 13, 2017, 5 pages.
Supplementary European Search Report issued by the European Patent Office for Application No. 13847526.4, dated Jul. 6, 2016, 10 pages.
Communication pursuant to Article 94(3) EPC issued by the European Patent Office for Application No. 14848692.1, dated Aug. 6, 2018, 7 pages.
Written Opinion and Search Report issued in Singaporean Patent Application No. 11201602237T, dated Jul. 31, 2018, 11 pages.
Communication pursuant to Article 94(3), issued by the European Patent Office for Application No. 13846555.4, dated Sep. 18, 2018, 6 pages.
Office Action issued by the Chinese Patent Office for Application No. 201380066223.1, dated May 21, 2018, 8 pages including English translation.
Office Action issued by the Chinese Patent Office for Application No. 201380066218, dated Jul. 27, 2018, 9 pages including English translation.
Notification to Grant Patent Right dated Oct. 29, 2018 by the Chinese Patent Office for Application No. 201380066223.1, 2 pages in English.
Notice of Allowance issued by the Mexican Patent Office for Application No. MX/a/2015/004944, reported Jun. 12, 2018, 2 pages.
Office Action issued by the Indonesian Patent Office for Application No. P-00201502939, dated Nov. 30, 2018, 2 pages.
Fourth Office Action issued by the Chinese Patent Office for Application No. 201380066218, dated Dec. 25, 2018, 13 pages including English translation.
Office Action issue by the European Patent Office for Application No. 13847526.4, dated Jan. 8, 2019, 6 pages.
Office Action issued by the Chinese Patent Office for Application No. 201380066218.0, dated Mar. 21, 2019, 14 pages including English translation.
Office Acton issued by the Canadian Patent Office for Application No. 2,888,251, dated Oct. 8, 2019, 5 pages.
Office Action issued by the Canadian Patent Office for Application No. 2,888,254, dated Oct. 11, 2019, 3 pages.
Summons to Attend Oral Hearing issued by the European Patent Office for Application No. 13847526.4, dated Oct. 22, 1019, 8 pages.

* cited by examiner

SUBSEA PROCESSOR FOR UNDERWATER DRILLING OPERATIONS

REFERENCES TO CO-PENDING APPLICATIONS

This application claims the benefit of priority to U.S. Provisional Patent Application No. 61/715,113 to Jose Gutierrez filed on Oct. 17, 2012 and entitled "Subsea CPU for Underwater Drilling Operations," and claims the benefit of priority to U.S. Provisional Patent Application No. 61/718,061 to Jose Gutierrez filed on Oct. 24, 2012 and entitled "Improved Subsea CPU for Underwater Drilling Operations," and claims the benefit of priority to U.S. Provisional Patent Application No. 61/883,623 to Luis Pereira filed on Sep. 27, 2013 and entitled "Next Generation Blowout Preventer (BOP) Control Operating System and Communications," each of which is incorporated by reference in their entirety.

STATEMENT OF GOVERNMENT SUPPORT

This invention was made with Government support under Work for Others Agreement No. NFE-12-04104 awarded by the United States Department of Energy. The Government has certain rights in this invention.

BACKGROUND

Conventional blow-out preventers (BOP) are generally limited in operational capability and operate based on hydraulics. When certain pressure conditions are detected, hydraulics within the blow-out preventers are activated to seal the well the BOP is attached to. These conventional BOPs have no processing capability, measurement capabilities, or communications capabilities.

BRIEF SUMMARY

A blow-out preventer (BOP) may be improved by having a subsea processing unit located underwater with the blow-out preventer. The processing unit may enable the blow-out preventer to function as a blow-out arrestor (BOA), because the processing unit may determine problem conditions exist that warrant taking action within the blow-out preventer to prevent and/or arrest a possible blow-out condition.

According to one embodiment, an apparatus may include an underwater drilling component, in which the underwater drilling component may include a physical receptor configured to receive a first processor unit, an inductive power device configured to transfer power to the first processor unit through the physical receptor, and a wireless communications system configured to communicate with the first processor unit through the physical receptor.

According to another embodiment, an apparatus may include a processor; an inductive power device coupled to the processor and configured to receive power for the processor; and a wireless communications system coupled to the processor and configured to communicate with an underwater drilling component.

According to yet another embodiment, a method of controlling an underwater drilling component may include receiving power, at a subsea processor, through an inductive coupling with the underwater drilling component, and communicating wirelessly, from the subsea processor, with the underwater drilling component to control the underwater drilling component.

According to a further embodiment, an apparatus may include at least one subsea component of an underwater drilling tool; and at least one subsea processor configured to wirelessly communicate with the subsea component, in which the at least one subsea component and the at least one subsea processor are configured to communicate according to a time division multiple access (TDMA) scheme.

According to another embodiment, a system may include at least one subsea component of an underwater drilling tool; at least two subsea processors configured to communicate with the at least one subsea component; and a shared communications bus between the at least one subsea component and the at least two subsea processors comprising a subsea network, in which the at least two subsea processors are configured to communicate on the shared communications bus according to a time division multiple access (TDMA) scheme.

According to yet another embodiment, a method may include receiving data, at a subsea processor, from a subsea component of an underwater drilling tool; processing the received data, at the subsea processor, to determine a command to control the subsea component; and transmitting the command, from the subsea processor, to the subsea component through a shared communications bus according to a time division multiple access (TDMA) scheme in a subsea network.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The following drawings form part of the present specification and are included to further demonstrate certain aspects of the present disclosure. The disclosure may be better understood by reference to one or more of these drawings in combination with the detailed description of specific embodiments.

DETAILED DESCRIPTION

A blow-out preventer (BOP) may be improved by having a subsea processing unit located underwater with the blow-out preventer. The processing unit may enable the blow-out preventer to function as a blow-out arrestor (BOA), because the processing unit may determine problem conditions exist that warrant taking action within the blow-out preventer to prevent and/or arrest a possible blow-out condition.

Figure 1:
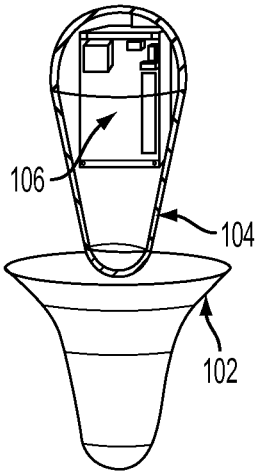
FIG. 1 is an illustration of a wireless subsea CPU unit and receptor for same according to one embodiment of the disclosure.

A receptor on the BOP may be designed to provide easy access to the processing unit for quick installation and replacement of the processing unit while the BOP is underwater. The receptor is illustrated as a receptor 102 in FIG. 1. The receptor 102 is designed to receive a processing unit 104, which includes a circuit board 106 containing logic devices, such as a microprocessor or microcontroller, and memory, such as flash memory, hard disk drives, and/or random access memory (RAM). Although a particular shape for the receptor 102 is illustrated, other shapes may be selected and the processing unit 104 adjusted to fit the receptor 102.

According to particular embodiments of the receptor 102, the receptor 102 may operate the BOP without electrical contact with the BOP. For example, an inductive power system may be incorporated in the BOP and an inductive receiver embedded in the processing unit 104. Power may then be delivered from a power source on the BOP, such as an undersea battery, to operate the circuit 106 within the processing unit 104. In another example, the BOP may communicate wirelessly with the circuit 106 in the processing unit 104. The communications may be, for example, by radio frequency (RF) communications.

Communications with the processing unit 104, and particularly the circuit 106 within the processing unit 104, may include conveyance of data from sensors within the BOP to the circuit 106 and conveyance of commands from the circuit 106 to devices within the BOP. The sensors may include devices capable of measuring composition and volume of mud and devices for kick detection. The sensors may be read by the processing unit 104 and used to determine action within the BOP. Although the BOP is referred to herein, the processing unit 104 may be attached to other undersea apparatuses. Additionally, although sensors and devices within the BOP are described herein, the circuit 106 may send and transmit data to other undersea devices not attached to the same apparatus as the processing unit 104.

The receptor 102 decreases the challenges associated with installing and maintaining the BOP. For example, because there are no physical connections between the processing unit 104 and the receptor 102, a new processing unit may easily be inserted into the receptor 102. This replacement action is easy for an underwater vehicle, such as a remotely-operated vehicle (ROV), to complete.

Further, because there are no physical connections between the processing unit 104 and the receptor 102, the processing unit 104 may be manufactured as a single piece unit. For example, the processing unit 104 may be manufactured by a three-dimensional printer, which can incorporate the circuit 106 into the processing unit 104. Because the processing unit 104 may be manufactured as a single piece, without construction seams, the processing unit 104 may be robust and capable of withstanding the harsh conditions in deep underwater drilling operations, such as the high water pressure present in deep waters.

When the circuit 106 of the processing unit 104 includes memory, the processing unit 104 may function as a black box for recording operations underwater. In the event a catastrophic event occurs, the processing unit 104 may be recovered and data from the processing unit 104 captured to better understand the events leading up to the catastrophic event and how efforts to prevent and/or handle the catastrophic event assisted in the recovery efforts.

Figure 2:
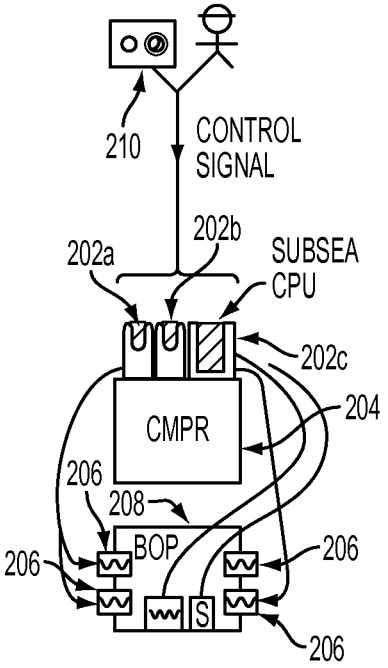
FIG. 2 is a block diagram illustrating an apparatus for receiving a wireless subsea CPU according to one embodiment of the disclosure.

A block diagram for implementing the processing unit 104 in an undersea system is illustrated in FIG. 2. An LMRP 204, including a blow-out preventer (BOP) 208 having rams 206, may have attached to one or more processing units 202*a*-202*c*. The processing units 202*a*-202*c* may be attached to the Lower Marine Riser Package (LMRP) 204 through a receptor similar to that illustrated in FIG. 1. When more than one processing unit is attached to the LMRP 204, the processing units may cooperate to control the LMRP 204 through a common data-bus. Even though the processing units 202*a*-202*c* may share a common data-bus, the processing units 202*a*-202*c* may each include separate memory. Each of the processing units 202*a*-202*c* may include a read-out port allowing an underwater vehicle to connect to one of the processing units 202*a*-202*c* to retrieve data stored in the memory of each of the processing units 202*a*-202*c*.

The processing units 202*a*-202*c* may be configured to follow a majority vote. That is, all of the processing units 202*a*-202*c* may receive data from sensors within the BOP 208. Then, each of the processing units 202*a*-202*c* may determine a course of action for the BOP 208 using independent logic circuitry. Each of the processing units 202*a*-202*c* may then communicate their decisions and the course of action agreed upon by a majority (e.g., two out of three) of the processing units 202*a*-202*c* may be executed.

Having multiple processing units on the LMRP 204, or other location in the BOP stack, also reduces the likelihood of failure of the LMRP 204 due to malfunctioning of the processing units. That is, fault tolerance is increased by the presence of multiple processing units. If any one, or even two, of the processing units 202*a*-202*c* fail, there remains a processing unit to continue to operate the BOP 208.

The processing units 202*a*-202*c* may also communicate wirelessly with a computer 210 located on the surface. For example, the computer 210 may have a user interface to allow an operator to monitor conditions within the BOP 208 as measured by the processing units 202*a*-202*c*. The computer 210 may also wirelessly issue commands to the processing units 202*a*-202*c*. Further, the computer 210 may reprogram the processing units 202*a*-202*c* through wireless communications. For example, the processing units 202*a*-202*c* may include a flash memory, and new logic functions may be programmed into the flash memory from the computer 210. According to one embodiment, the processing units 202*a*-202*c* may be initially programmed to operate the rams 206 by completely opening or completely closing the rams 206 to shear a drilling pipe. The processing units 202*a*-202*c* may later be reprogrammed to allow variable operation of the rams 206, such as to partially close the rams 206. Although the computer 210 may interface with the processing units 202*a*-202*c*, the processing units 202*a*-202*c* may function independently in the event communications with the computer 210 is lost.

The processing units 202*a*-202*c* may issue commands to various undersea devices, such as the BOP 208, through electronic signals. That is, a conducting wire may couple the receptor for the processing units 202*a*-202*c* to the device. A wireless signal containing a command may be conveyed from the processing units 202*a*-202*c* to the receptor and then through the conducting wire to the device. The processing units 202*a*-202*c* may issue a sequence of commands to devices in the BOP 208 by translating a command received from the computer 210 into a series of smaller commands.

The processing units 202*a*-202*c* may also issue commands to various undersea devices through a hybrid hydraulic-electronic connection. That is, a wireless signal containing a command may be conveyed from the processing units 202*a*-202*c* to the receptor and then converted to hydraulic signals that are transferred to the BOP 208 or other undersea devices.

An independent processor on a BOP, such as the processing units 202*a*-202*c* on the BOP 208, may provide additional advantages to the BOP, such as reduced maintenance of the BOP. BOPs may be recalled to the surface at certain intervals to verify the BOP is functional, before an emergency situation occurs requiring the BOP to arrest a blow-out. Recalling the BOP to the surface places the well out of service while the BOP is being serviced. Further, significant effort is required to recall the BOP to the surface. Many times these maintenance events are unnecessary, but without communications to the BOP the status of the BOP is unknown, and thus the BOP is recalled periodically for inspection.

When the processing units 202*a*-202*c* are located with the BOP 208 and in communication with sensors within the BOP 208, the processing units 202*a*-202*c* may determine when the BOP 208 should be serviced. That is, the BOP 208 may be programmed with procedures to verify operation of components of the BOP 208, such as the rams 206. The verification procedures may include cutting a sample pipe, measuring pressure signatures, detecting wear, and/or receiving feedback from components (e.g., that the rams are actually closed when instructed to close). The verification procedures may be executed at certain times, and the BOP 208 may not be recalled unless a problem is discovered by the verification procedures. Thus, the amount of time spent servicing the BOP 208 may be reduced.

Figure 3:
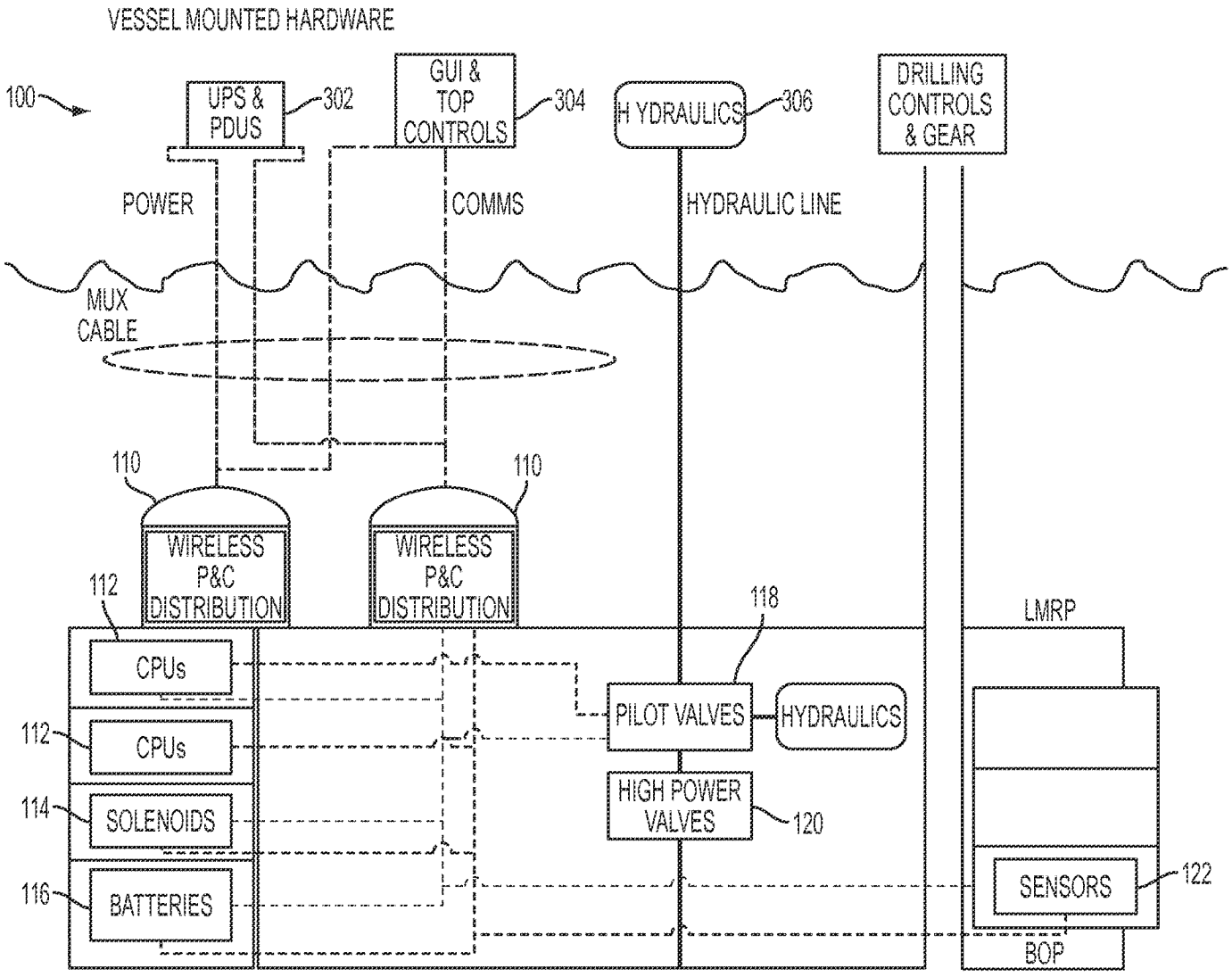
FIG. 3 is a block diagram illustrating a hybrid wireless implementation of the subsea CPUs according to one embodiment of the disclosure.

The processing units may be implemented in a hybrid wireless system having some wired connections to the surface, such as shown in the block diagram of FIG. 3. A power system 302, a control system 304, and a hydraulics system 306 may be located on a drilling vessel or drilling rig on the sea surface. Wired connections may connect the power system 302 and the control system 304 to a wireless distribution center 110 on an undersea apparatus. In one embodiment, the wire connections may provide broadband connections over power lines to the surface. The wireless distribution center 110 may relay signals from the power system 302 and the control system 304 to and from undersea components, such as processing units 112, solenoids 114, batteries 116, pilot valves 118, high power valves 120, and sensors 122. The hydraulics 306 may also have a physical line extending to the subsea components, such as the pilot valves 118. The hydraulics line, communications line, and power line may be embedded in a single pipe, which extends down to the undersea components on the sea floor. The pipe having the physical lines may be attached to the riser pipe extending from the drilling rig or drilling vessel to the well on the sea floor.

Figure 4:
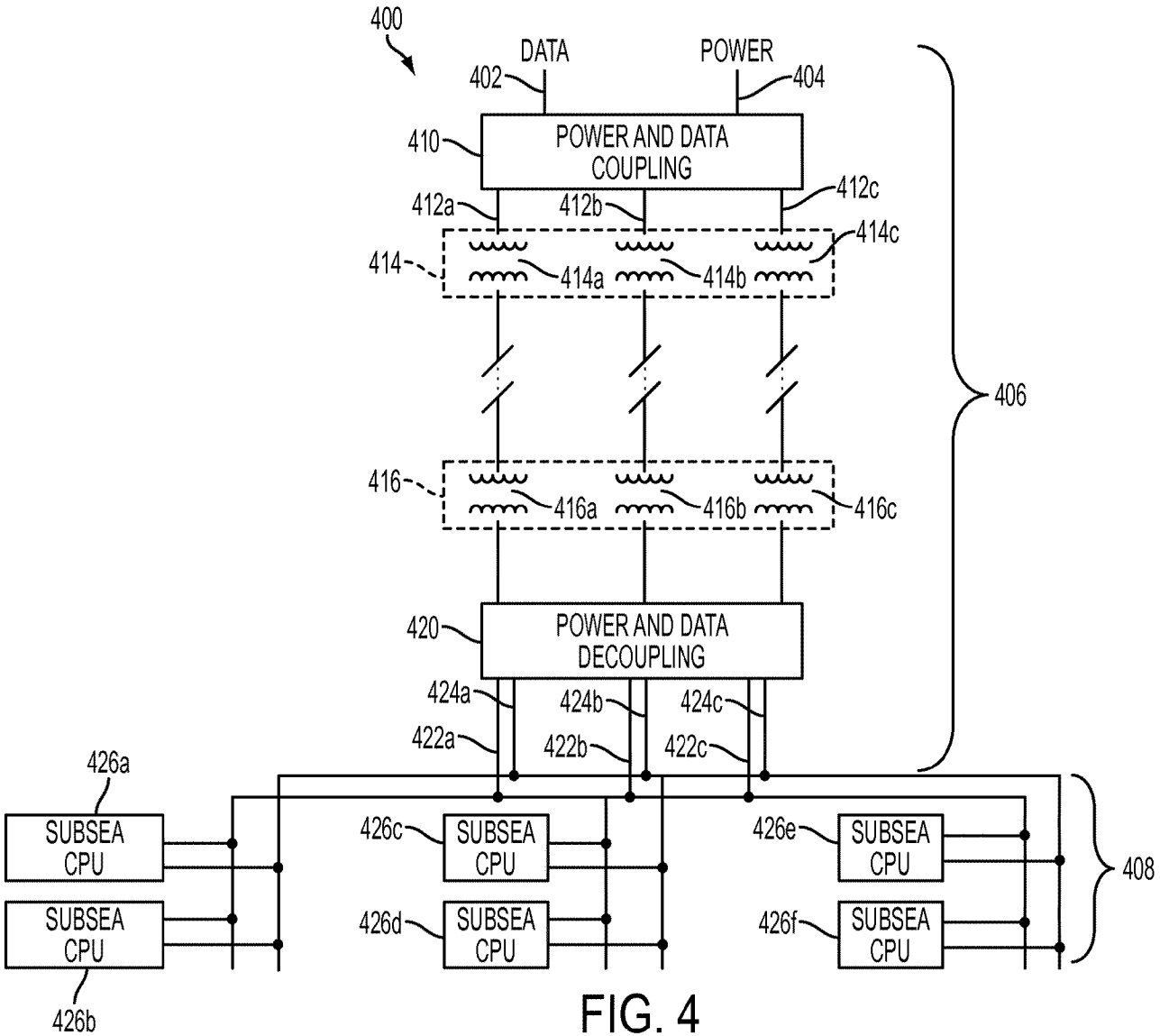
FIG. 4 is a block diagram illustrating a combined power and communications system for a BOP according to one embodiment of the disclosure.

In one embodiment, a wired communications system may interconnect the processing units 202*a*-*c* of FIG. 2 for communications and power distribution. FIG. 4 is a block diagram illustrating a combined power and communications system for a BOP according to one embodiment of the disclosure. FIG. 4 illustrates the reception of a data signal 402 and a power signal 404, the mechanisms for transmitting the data signal 402 and/or the power signal 404, and the distribution of data and/or power to a plurality of subsea CPUs 426*a*-426*f* associated with a BOP. According to some embodiments, the communications illustrated by FIG. 4 corresponds to communications between an offshore platform and a network in communication with a BOP and/or the BOP's components located near the sea bed.

Figure 5:
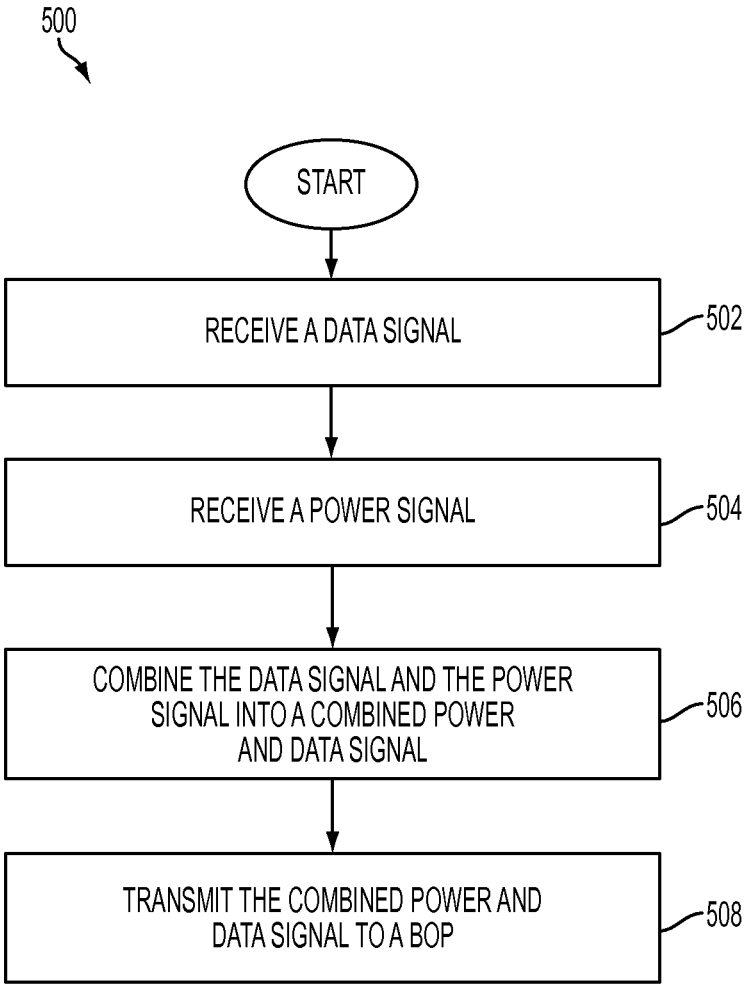
FIG. 5 is a flow chart illustrating a method for distributing power and data to a subsea CPU according to one embodiment of the disclosure

FIG. 5 is a flow chart illustrating a method for distributing power and data to a subsea CPUs according to one embodiment of the disclosure. A method 500 may start at block 502 with receiving a data signal, such as the data signal 402. At block 504, a power signal, such as the power signal 404, may be received. The received power signal 404 may be, for example, a direct current (DC) or an alternating current (AC) power signal. The received data signal 402 and the received power signal 404 may be received from an onshore network (not shown), from a subsea network (not shown), or from a surface network (not shown) such as an offshore platform or drilling rig.

At block 506, the data signal 402 and the power signal 404 may be combined to create a combined power and data signal. For example, referring to FIG. 4, the power and data coupling component 410 may receive the data signal 402 and power signal 404, and output at least one combined power and data signal 412*a*. The power and data coupling component 410 may also output redundant combined power and data signals 412*b* and 412*c*. Redundant signals 412*b* and 412*c* may each be a duplicate of signal 412*a* and may be transmitted together to provide redundancy. Redundancy provided by the multiple combined power and data signals 412*a*-412*c* may improve reliability, availability, and/or fault tolerance of the BOP.

According to one embodiment, the power and data coupling component 410 may inductively couple the data signal 402 and the power signal 404. For example, the power and data coupling component 410 may inductively modulate the power signal 404 with the data signal 402. In one embodiment, the power and data coupling component 410 may utilize a broadband over power lines (BPL) standard to couple the data signal 402 and the power signal 404. In another embodiment, the power and data coupling component 410 may utilize a digital subscriber line (DSL) standard to couple the data signal 402 and the power signal 404 together.

Returning to FIG. 5, the method 500 may include, at block 508, transmitting the combined power and data signal 412 to a network within a BOP. A network within the BOP may include a subsea processing unit and a network of control, monitoring, and/or analysis applications executing on the subsea processing units or other processing systems within the BOP.

In one embodiment, the combined power and data signals 412*a*-412*c* may be transmitted without stepping up and/or down the voltage of signals 412*a-c,* in which case transformer blocks 414 and 416 may be bypassed or not present. In another embodiment, the redundant combined power and data signals 412*a*-412*c* may have their voltage stepped up via transformer block 414 prior to transmitting the combined power and data signals 412*a*-412*c* to the BOP and/or other components near the sea bed. The redundant combined power and data signals 412*a*-412*c* may have their voltage stepped down via transformer block 416 upon receipt at the BOP or other components located at the sea bed. Each transformer block may include a separate transformer pair for each combined power and data line 412*a*-412*c*. For example, transformer block 414 may include transformer pairs 414*a*-414*c* to match the number of redundant combined power and data signals 412*a*-412*c* being transmitted to the BOP control operating system network/components at the sea bed. As another example, transformer block 416 may include transformer pairs 416*a*-416*c* to also match the number of redundant combined power and data signals 412*a*-412*c* transmitted to the BOP or other components at the sea bed.

According to one embodiment, the transformer block 414 may be located at the offshore platform/drilling rig to step up the voltage of combined power and data signals 412*a*-412*c* transmitted to the sea bed. The transformer block 416 may be located near the sea bed and may be coupled to the BOP to receive the combined power and data signals 412*a*-412*c* transmitted from the offshore platform.

After being received by the BOP, the combined power and data signal 412 may be separated to separate the data signal from the power signal with a power and data decoupling component 420. Separating the data signal from the power signal after the combined power and data signal 412 is received at the BOP may include inductively decoupling the data signal from the power signal to create power signals 422*a*-422*c* and the data signals may be data signals 424*a*-424*c*. According to one embodiment, the power and data decoupling component 420 may separate the data and power signals by inductively demodulating the received combined power and data signals 412*a*-412*c*. After separating the power and data signals to obtain power signals 422*a*-422*c* and data signals 424*a*-424*c,* the signals may be distributed to the subsea CPUs 426*a*-426*f* or other components of a BOP or LMRP as shown in section 408.

Figure 6:
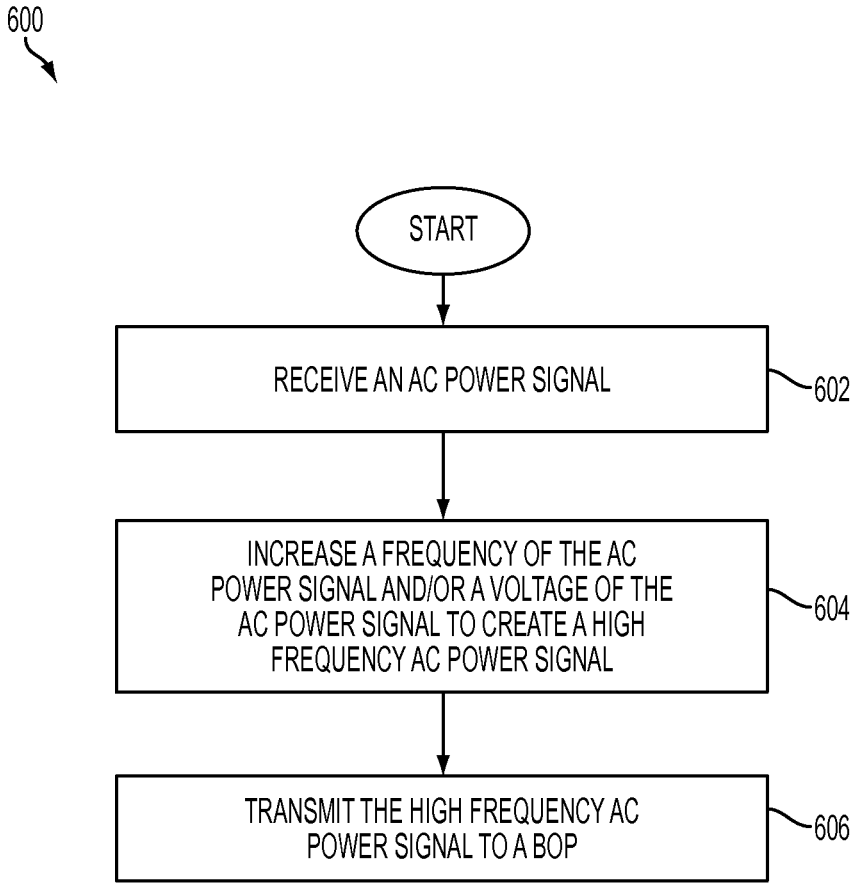
FIG. 6 is a flow chart illustrating a method for high frequency distribution of power to a subsea network according to one embodiment of the disclosure.

As described above, the voltage may be stepped up for transmission of power to a BOP. Likewise, the frequency may be increased for distribution to components in section 408 of a BOP, including subsea processors 426*a*-426*f*. The use of high frequency power distribution may reduce the size and weight of the transformers used for transmitting signals. FIG. 6 is a flow chart illustrating a method for high frequency distribution of power to a subsea network according to one embodiment of the disclosure. A method 600 begins at block 602 with receiving an AC power signal. At block 604, the frequency of the AC power signal may be increased, and optionally the voltage of the AC power signal increased, to create a high frequency AC power signal. The AC power signal may be combined with a data signal such that the AC power signal includes a combined power and data signal, as shown in FIGS. 4 and 5. According to one embodiment, the frequency and/or voltage of the AC power signal may be increased at the offshore platform. For example, referring back to FIG. 4, the power and data coupling component 410, which may be located on the offshore platform, may also be used to increase the frequency at which the data, power, and/or combined power and data are transmitted. The frequency of the AC power signal may be increased with a frequency changer. The transformer block 414, which may also be located at the offshore platform, may be used to increase the voltage at which the data, power, and/or combined power and data are transmitted.

Returning to FIG. 6, the method 600 may include, at block 606, transmitting the high frequency AC power signal to a subsea network. After being received at or near the sea bed, the transmitted high frequency AC power signal may be stepped down in voltage with transformer block 416 and/or the frequency of the transmitted high frequency signal may be reduced at the subsea network. For example, the power and data decoupling component 420 of FIG. 4, may include functionality to reduce the frequency of the received high frequency power or combined power and data signal.

The high frequency AC power signal may be rectified after being transmitted to create a DC power signal, and the DC power signal may be distributed to different components within section 408 of FIG. 4. For example, the rectified power signals may be power signals 422*a*-422*c,* which may be DC power signals. Specifically, DC power signals 422*a*-422*c* may be distributed to a plurality of subsea CPUs 426*a*-426*f*. In one embodiment, the rectifying of the high frequency AC power signal may occur near the sea bed. The distribution of a DC signal may allow for less complex power distribution and allow use of batteries for providing power to the DC power signals 422*a*-422*c*.

The subsea CPUs 426*a*-426*f* may execute control applications that control various functions of a BOP, including electrical and hydraulic systems. For example, the subsea CPU 426*a* may control a ram shear of a BOP, while the subsea CPU 426*e* may executes a sensor application that monitors and senses a pressure in the well. In some embodiments, a single subsea CPU may perform multiple tasks. In other embodiments, subsea CPUs may be assigned individual tasks. The various tasks executed by subsea CPUs are described in more detail with reference to FIG. 7.

Figure 7A:
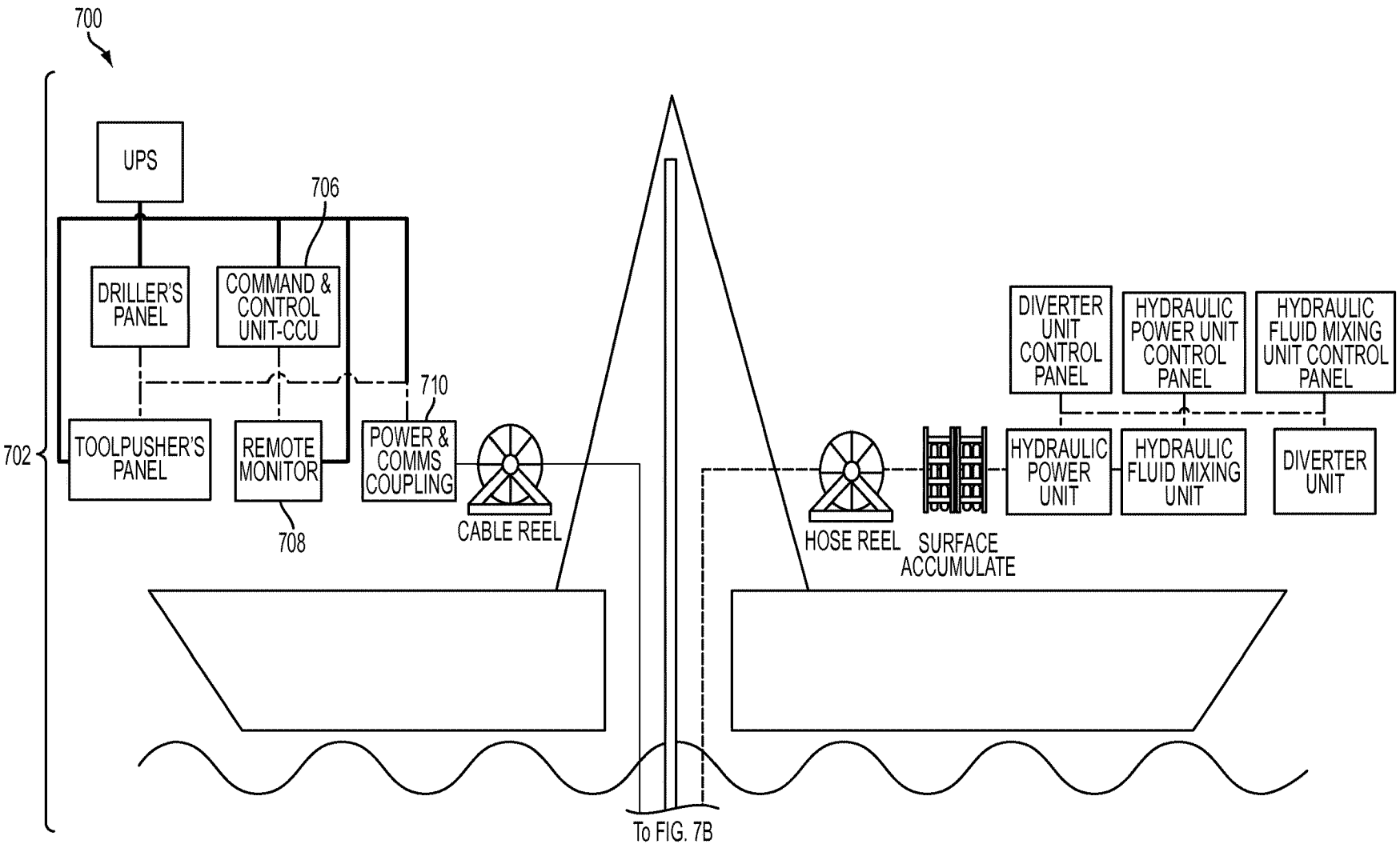
FIG. 7 is a block diagram illustrating a riser stack with subsea CPUs according to one embodiment of the disclosure.
Figure 7B:
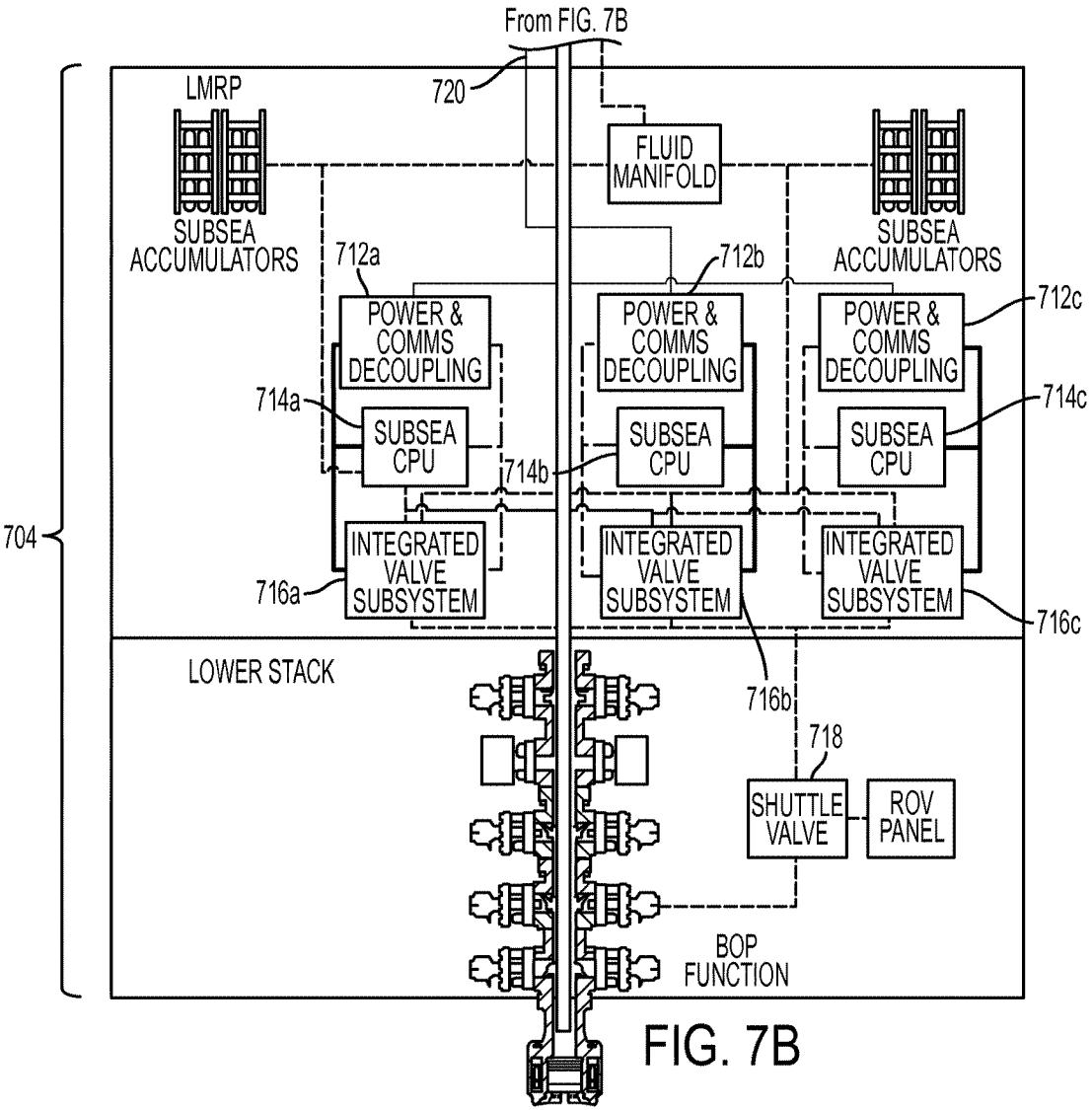

FIG. 7 is a block diagram illustrating a riser stack with subsea CPUs according to one embodiment of the disclosure. A system 700 may include an offshore drilling rig 702 and a subsea network 704. The system 700 includes a command and control unit (CCU) 706 on the offshore drilling rig 702. The offshore drilling rig 702 may also include a remote monitor 708. The offshore drilling rig 702 may also include a power and communications coupling unit 710, such as described with reference to FIG. 4. The subsea network 704 may include a power and communications decoupling unit 712, such as described with reference to FIG. 4. The subsea network 704 may also include a subsea CPU 714 and a plurality of hydraulic control devices, such as an integrated valve subsystem 716 and/or shuttle valve 718.

Redundancy may be incorporated into the system 700. For example, each of the power and communications decoupling units 712*a*-712*c* may be coupled on a different branch of the power and communications line 720. In addition, component groups may be organized to provide redundancy. For example, a first group of components may include a power and communications decoupling unit 712*a*, a subsea CPU 714*a*, and a hydraulic device 716*a*. A second group of components may include a power and communications decoupling unit 712*b*, a subsea CPU 714*b*, and a hydraulic device 716*b*. The second group may be arranged in parallel with the first group. When one of the components in the first group of components fails or exhibits a fault, the BOP function may still be available with the second group of components providing control of the BOP function.

The subsea CPUs may manage primary processes including well control, remotely operated vehicle (ROV) intervention, commanded and emergency connect or disconnect, pipe hold, well monitoring, status monitoring, and/or pressure testing. The subsea CPUs may also perform prognostics and diagnostics of each of these processes.

The subsea CPUs may log data for actions, events, status, and conditions within a BOP. This logging capability may allow for advanced prognostic algorithms, provide information for continuously improving quality processes, and/or provide detailed and automated input for failure mode analysis. The data logging application may also provide an advanced and distributed data logging system that is capable of reproducing, in a simulation environment, the exact behavior of a BOP system when the data logs are run offline. In addition, a built-in memory storage system may act as a black box for the BOP such that information stored in it can be used for system forensics at any time. The black box functionality may allow for self-testing or self-healing by a BOP employed within the BOP control operating system with a control application, as disclosed herein. Each state-based activity (actions, triggers, events, sensor states, and so on) may be registered in the advanced data logging system so that any functional period of the BOP may be replayed online or offline.

Various communications schemes may be employed for communication between subsea CPUs and/or between subsea CPUs and other components of the subsea network, the onshore network, and the offshore network. For example, data may be multiplexed onto a common data bus. In one embodiment, time division multiple access (TDMA) may be employed between components and applications executing on those components. Such a communication/data transfer scheme allows information, such as sensing data, control status, and results, to be made available on a common bus. In one embodiment, each component, including the subsea CPUs, may transmit data at predetermined times and the data accessed by all applications and components. By having a time slot for communication exchange, the possibility of data loss due to queuing may be reduced or eliminated. Moreover, if any of the sensor/components fail to produce the data at their specified timeslot, the system may detect the anomaly within a fixed time interval, and any urgent/emergency process can be activated.

In one embodiment, a communication channel between components may be a passive local area network (LAN), such as a broadcast bus that transports one message at a time. Access to the communication channel may be determined by a time division multiple access (TDMA) scheme in which timing is controlled by a clock synchronization algorithm using common or separate real-time clocks.

Figure 8:
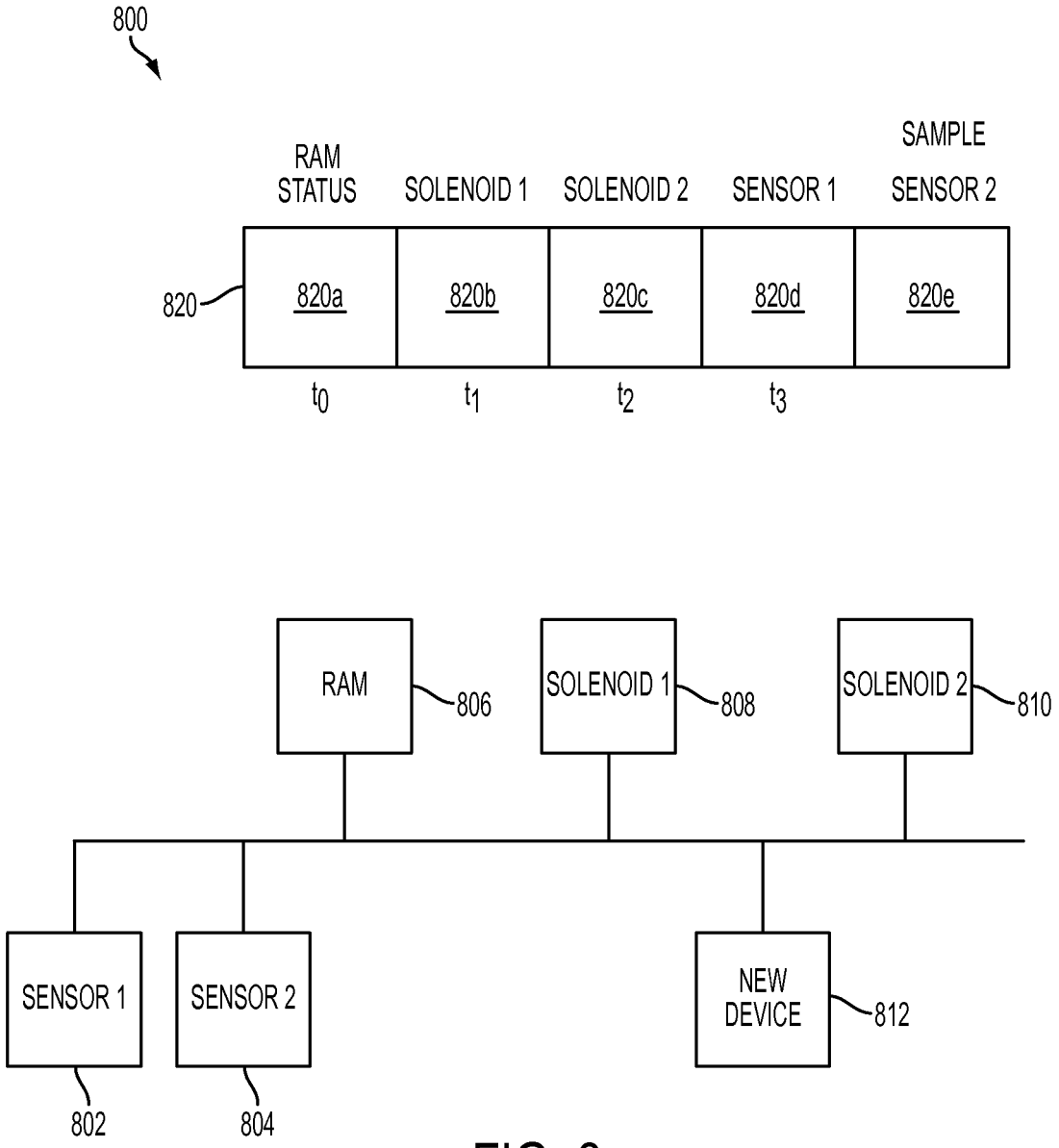
FIG. 8 is a block diagram illustrating components of a subsea network communicating through a TDMA scheme according to one embodiment of the disclosure.

FIG. 8 is a block diagram illustrating components of a subsea network communicating through a TDMA scheme. A subsea network 800 may include sensors 802 and 804, a shear ram 806, solenoids 808 and 810, and other devices 812. The components of the subsea network 800 may communicate through a TDMA scheme 820. In the TDMA scheme 820, a time period for communicating on a shared bus may be divided into time slots and those time slots assigned to various components. For example, a time slot 820*a* may be assigned to the ram 806, a time slot 820*b* may be assigned to the solenoid 808, a time slot 820*c* may be assigned to the solenoid 810, a time slot 820d may be assigned to the sensor 802, and a time slot 802e may be assigned to the sensor 804. The time period illustrated in the TDMA scheme 820 may be repeated with each component receiving the same time slot. Alternatively, the TDMA scheme 820 may be dynamic with each of the slots 820*a-e* being dynamically assigned based on the needs of the components in the system 800.

Figure 9:
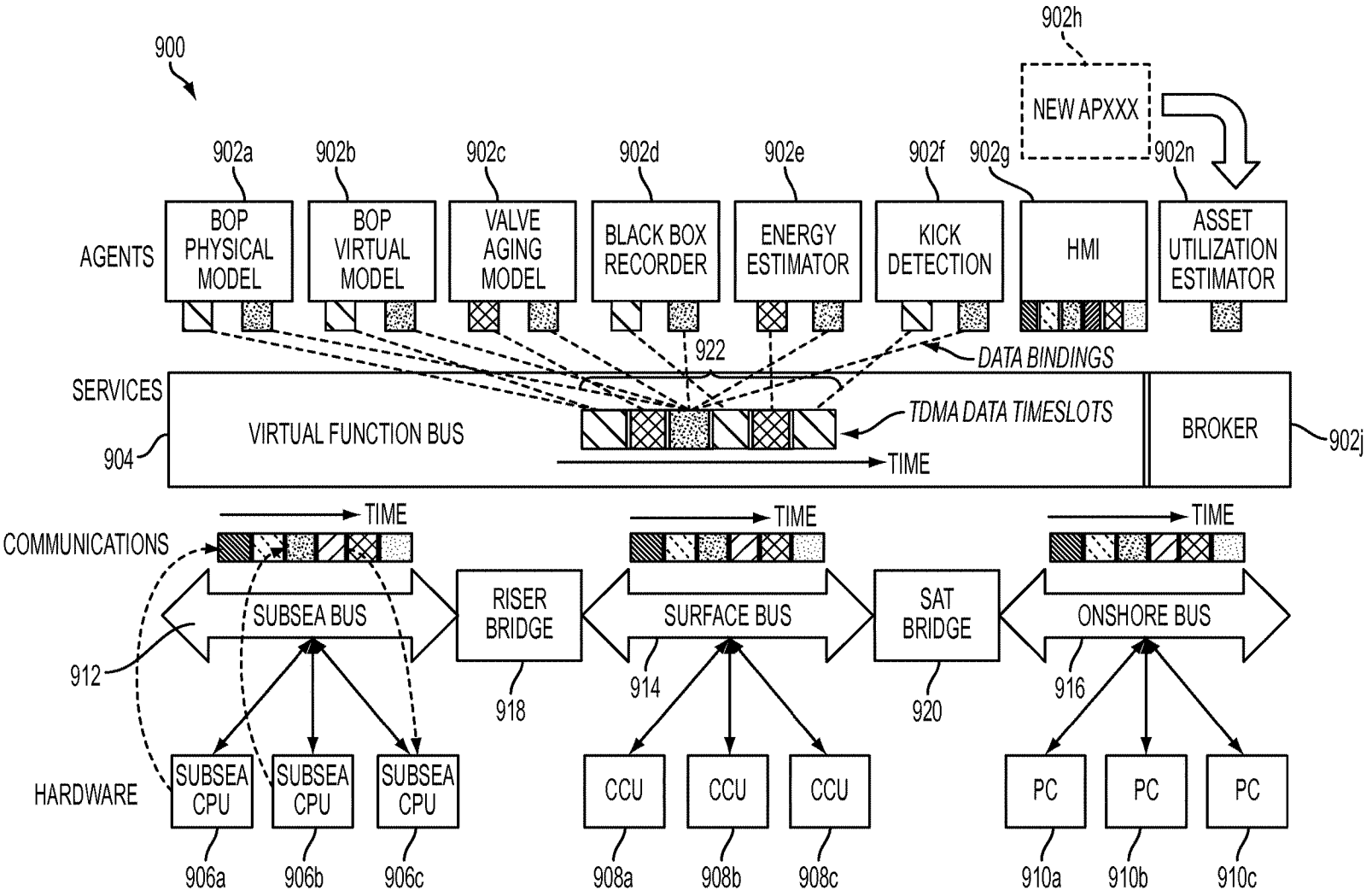
FIG. 9 is a block diagram illustrating a TDMA scheme for communications between applications executing on subsea CPUs according to one embodiment of the disclosure.

Applications executing on subsea CPUs may also share time slots of a shared communications bus in a similar manner. FIG. 9 is a block diagram illustrating a TDMA scheme for communications between applications executing on subsea CPUs according to one embodiment of the disclosure. According to an embodiment, a system 900 may include a plurality of applications 902*a*-902*n*. An application 902 may be a software component executed with a processor, a hardware component implemented with logical circuitry, or a combination of software and/or hardware components.

Applications 902*a*-902*n* may be configured to perform a variety of functions associated with control, monitoring, and/or analysis of a BOP. For example, an application 902 may be configured as a sensor application to sense hydrostatic pressure associated with a BOP. In another example, the application 902 may be configured to perform a diagnostic and/or prognostic analysis of the BOP. In a further example, an application 902 may couple to a BOP and process parameters associated with a BOP to identify an error in the current operation of the BOP. The process parameters monitored may include pressure, hydraulic fluid flow, temperature, and the like. Coupling of an application to a structure, such as a BOP or offshore drilling rig, may include installation and execution of software associated with the application by a processor located on the BOP or the offshore drilling rig, and/or actuation of BOP functions by the application while the application executes on a processor at a different location.

A BOP control operating system may include an operating system application 902*j* to manage the control, monitoring, and/or analysis of a BOP with the applications 902*a*-902*n*. According to one embodiment, the operating system application 902*j* may broker communications between the applications 902*a*-902*n*.

The system 900 may include a subsea central processing unit (CPU) 906*a* at the sea bed and may be assigned to application 902*a*. The system 900 may also include a command and control unit (CCU) 908*a*, which may be a processor coupled to an offshore drilling rig in communication with the BOP, and may be assigned to application 902*c*. The system 900 may also include a personal computer (PC) 910*a* coupled to an onshore control station in communication with the offshore drilling rig and/or the BOP, which may be assigned to application 902*e*. By assigning a processing resource to an application, the processing resource may execute the software associated with the application and/or provide hardware logical circuitry configured to implement the application.

Each of the subsea CPUs 906*a*-906*c* may communicate with one another via the subsea bus 912. Each of the CCUs 908*a*-908*c* may communicate with one another via the surface bus 914. Each of the PCs 910*a*-910*c* may communicate with one another via the onshore bus 916. Each of the buses 912-916 may be a wired or wireless communication network. For example, the subsea bus 912 may be a fiber optical bus employing an Ethernet communication protocol, the surface bus 914 may be a wireless link employing a Wi-Fi communication protocol, and the onshore bus 916 may be a wireless link employing a TCP/IP communication protocol. Each of the subsea CPUs 906*a*-906*c* may be in communication with the subsea bus 912.

Communication between applications is not limited to communication in the local subsea communication network 912, the surface communication network 914, or the onshore communication network 916. For example, an application 902*a* implemented by the subsea CPU 906*a* may communicate with an application 902f implemented by the PC 910*c* via the subsea bus 912, a riser bridge 918, the surface bus 914, a SAT bridge 920, and the onshore bus 916. In one embodiment, the riser bridge 918 may be a communication network bridge that allows communication between the subsea network 912 and local water surface network 914. The SAT bridge 920 may be a communication network bridge that allows communication between the surface network 914 and the onshore network 916, and the SAT bridge 920 may include a wired communication medium or a wireless communication medium. Therefore, in some embodiments, applications 902*a*-902*n* associated with the subsea network 912 may communicate with applications 902*a*-902*n* implemented anywhere in the world because of the global reach of onshore communication networks that may make up the SAT bridge 920. For example, the SAT bridge 920 may include a satellite network, such as a very small aperture terminal (VSAT) network, and/or the Internet. Accordingly, the processing resources that may be allocated to an application 902 may include any processor located anywhere in the world as long as the processor has access to a global communication network, such as VSAT, and/or the Internet.

Figure 10:
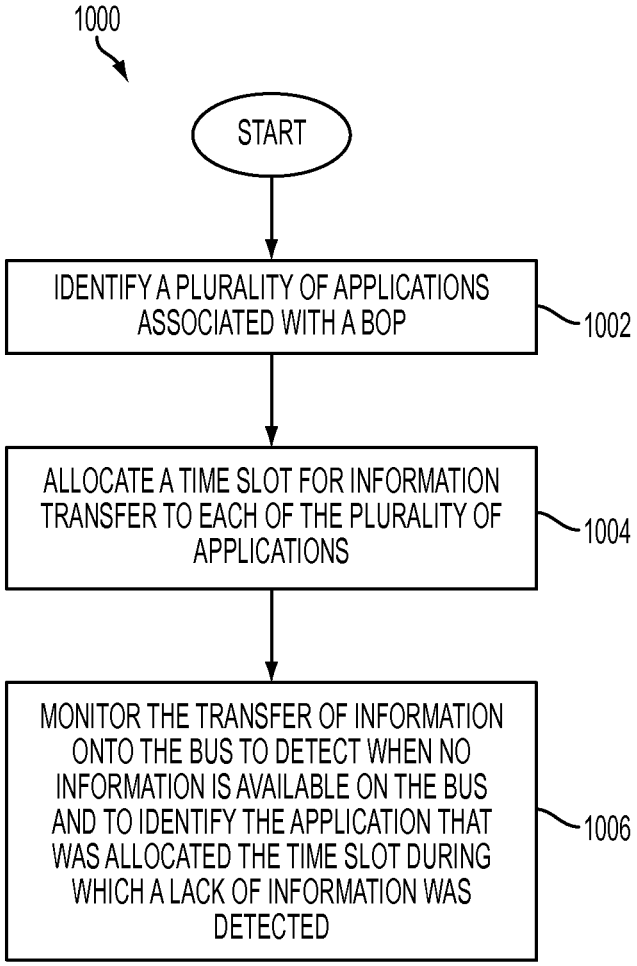
FIG. 10 is a flow chart illustrating a method for communicating components according to one embodiment of the disclosure.

An example of scheduling the transfer of information from the plurality of applications onto a shared bus is shown in FIG. 10. FIG. 10 is a flow chart illustrating a method for communicating components according to one embodiment of the disclosure. A method 1000 may be implemented by the operating system application 902*j* of FIG. 9, which may also be configured to schedule the transfer of information from the plurality of applications onto a bus. The method 1000 starts at block 1002 with identifying a plurality of applications, such as those associated with a BOP. For example, each of the communication networks 912-916 may be scanned to identify applications. In another example, the applications may generate a notification indicating that the application is installed. The identified plurality of applications may be applications that control, monitor, and/or analyze a plurality of functions associated with the BOP, such as the applications 902*a*-902*n* in FIG. 9.

At block 1004, a time slot for information transfer may be allocated to each of the applications. The applications may transfer information onto he bus during the time slot. In some embodiments, an application may be able to transfer information onto the bus during time slots allocated to other applications, such as during emergency situations. The time slot during which an application may transfer data may be periodic and may repeat after a time period equal to the sum of all the time slots allocated to applications for information transfer.

Referring to FIG. 9, each of applications 902*a*-902*n* may be coupled to a virtual function bus 904 through the buses 912-916 in the system 900. The virtual function bus 904 may be a representation of the collaboration between all of the buses 912-916 to reduce the likelihood that two applications are transferring information onto the bus at the same time. For example, if an application associated with the surface network 914 is attempting to transfer information to the surface bus 914 during an allocated time slot, then no other application, such as an application associated with either the subsea bus 912 or the onshore bus 916, may transfer information onto their respective local network buses. This is because the virtual function bus 904 has allocated the time slot for the application in the surface bus 914. The virtual function bus 904 may serve as the broker between the buses 912-916 and the applications 902*a*-902*n*.

According to an embodiment, time span 922 may represent all the time needed for every application in the system to be allocated a time slot. Each of the time slots may or may not be equal durations. For example, a first time slot may be 10 ms, while a second time slot may be 15 ms. In other embodiments, each of the time slots may be of the same duration. The allocation of a time slot and the duration of a time slot may be dependent on the information associated with the application. For example, an application configured to monitor hydraulic functions of the BOP may be assigned more time than an application that simply reads information from a memory. Each of the applications may have a clock that synchronizes each of the applications.

Returning to FIG. 10, at block 1006, the transfer of information onto the bus may be monitored to detect when no information is available on the bus, and to identify the application that was allocated the time slot during which the lack of information on the bus was detected. In some embodiments, when a lack of information is detected on the bus, an emergency BOP control process may be activated, such as a BOP ram actuation. In other embodiments, when a lack of information is detected on the bus, a notification and/or an alarm may be actuated, such as a notification and/or alarm on a user interface. According to another embodiment, when a lack of information is detected on the bus, a request may be made for the data to be resent, or no action may be taken.

Figure 11:
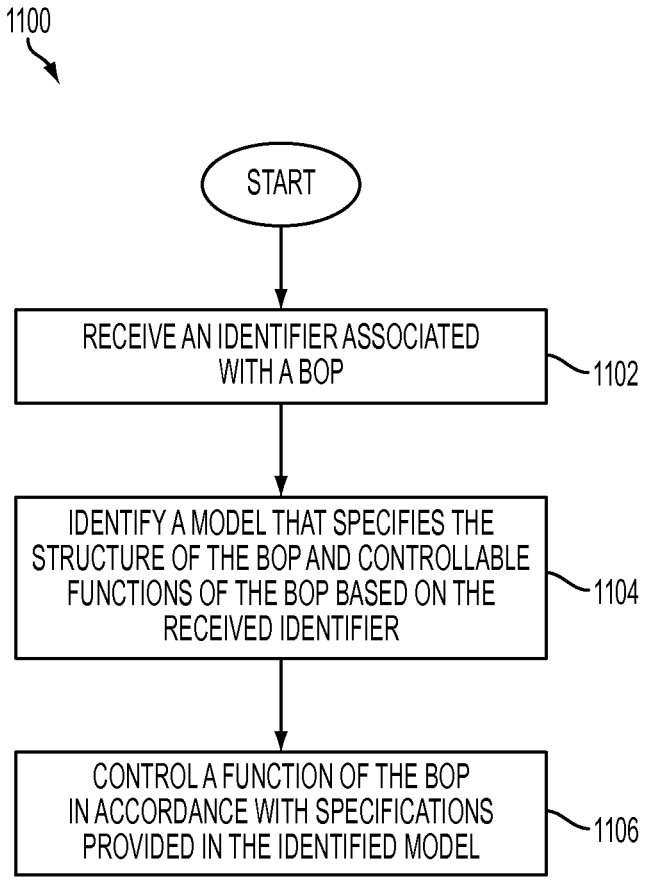
FIG. 11 is a flow chart illustrating a method for controlling a BOP based on a model according to one embodiment of the disclosure.

The applications 902*a*-*g* may control a BOP autonomously according to pre-programmed models. FIG. 11 is a flow chart illustrating a method for controlling a BOP based on a model according to one embodiment of the disclosure. A method 1100 starts at block 1102 with receiving a first identifier associated with a BOP. The first identifier may be used within a service discovery protocol to identify a first model that specifies the structure of the BOP and a plurality of controllable functions of the BOP. In one embodiment, the model may be identified by comparing the received identifier to a database of BOP models, where each BOP model in the database of BOP models may be associated with a unique identifier that can be compared to the received identifier. In some embodiments, the model may include a behavioral model or a state machine model. At block 1106, a function of the BOP may be controlled in accordance with specifications provided in the identified model.

A display representative of the identified model may be outputted at a user interface. The user interface may include a user interface for the BOP at the sea bed, a user interface for communicating from an offshore drilling rig to the BOP, and/or a user interface for communicating from an onshore control station to the offshore drilling rig and/or the first BOP. The user interface may be one of the applications 902*a*-902*n* of FIG. 9. For example, referring to FIG. 9, a user interface application may include application 902*g*, which is a human machine interface (HMI). The HMI application may have access to read information during any time slot and/or be able to transfer information onto any of the buses 912-916 during any time slot. For example, in one embodiment, information from an HMI may be allowed to be transferred onto any of the buses 912-916 during any time slot to enforce an override mechanism wherein a user is able to override the system in emergency situations. In some embodiments, the HMI application may access any information stored or processed in any application and display a visual representation of the information.

According to an embodiment, user input may be received at the user interface, and the controlling of the first function of the BOP may be based on the received input. According to another embodiment, parameters associated with the BOP may be received and processed with at least one of a processor coupled to the BOP at the sea bed, a processor coupled to an offshore drilling rig in communication with the BOP, and a processor coupled to an onshore control station in communication with the offshore drilling rig and/or the BOP. The controlling of the first function of the BOP may then be performed based on the processing of the received parameters. In some embodiments, the BOP may include a live running BOP, such as a BOP in operation at the sea bed, and the model may include a real-time model for the live-running BOP. If the BOP is a live-running BOP, then the controlling of the functions of the BOP may happen in real-time based on user input provided at a user interface and/or processing of parameters associated with the first BOP.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A system comprising:

one or more processor units, each including:

a housing;

a processor configured to be disposed within the housing; and an inductive power receiving device configured to be coupled to the processor and configured to be disposed within the housing, the inductive power receiving device configured to receive power for the processor through the housing and from a receptacle of an underwater drilling component, the receptacle being one of one or more receptacles of the underwater drilling component, each of the one or more receptacles:

defining a volume configured to removably receive within the volume a respective one of the one or more processor units;

including an inductive power transmitting device configured to transfer power to the inductive power receiving device of the respective processor unit; and positioned on the underwater drilling component to permit coupling of the respective processor unit to the receptacle from an exterior of the underwater drilling component; and at least one sensor; and a wireless communications system configured to permit communication between the at least one sensor and at least one of the one or more processor units, at least one of the one or more processor units being configured to control the underwater drilling component based, at least in part, on data captured by the at least one sensor.

2. The system of claim 1, wherein:

the one or more processor units includes three or more processor units; and the one or more receptacles includes three or more receptacles, each configured to receive a respective one of the three or more processor units.

3. The system of claim 2, in which the three or more processing units are configured to control the underwater drilling component according to a majority voting scheme.

4. The system of claim 1, in which the underwater drilling component comprises a blow-out preventer (BOP).

5. The system of claim 1, in which the system comprises a memory configured to store data captured by the at least one sensor.

6. The system of claim 1, in which the wireless communications system is configured to receive commands from at least one of an offshore network and an onshore network.

7. The system of claim 6, in which the wireless communications system is configured to transmit the commands to the underwater drilling component to control the underwater drilling component.

8. The system of claim 1, wherein at least one of the one or more processor units is configured to control the underwater drilling component according to a model.

9. The system of claim 1, in which at least one of the one or more processor units is configured to receive an identifier from the underwater drilling component and control the underwater drilling component according to a model corresponding to the received identifier.

10. The system of claim 1, in which the wireless communications system is configured to permit communication between at least two of the one or more processor units.

11. The system of claim 1, in which, for at least one of the one or more processor units, the housing is a single-piece, seamless unit.

12. The system of claim 1, wherein each receptacle from the one or more receptacles is configured to at least partially enclose a portion of the respective processor unit when the respective processor unit is received within the volume of the respective receptacle.

13. The system of claim 1, wherein each receptacle is at least partially conical in shape.

14. A method of controlling an underwater drilling component, the method comprising:

removably coupling a processor unit to a receptacle of the underwater drilling component from an exterior of the underwater drilling component, the processor unit including a housing and an inductive power receiving device contained within the housing, the removably coupling including disposing the processor unit at least partially within a volume defined by the receptacle;

powering the processor unit through an inductive coupling with the receptacle by transmitting inductive power from an inductive power transmitting device to the inductive power receiving device;

receiving, at the processor unit, data captured by at least one sensor of the underwater drilling component; and controlling, with the processor unit, the underwater drilling component based, at least in part, on data captured by the at least one sensor.

15. The method of claim 14, further comprising receiving, at the processor unit, an identifier from the underwater drilling component.

16. The method of claim 15, wherein controlling the underwater drilling component is performed according to a model.

17. The method of claim 16, wherein the model corresponds to the received identifier.

18. The method of claim 14, wherein the processor unit is from a plurality of processor units, the method further comprising:

the plurality of processor units includes three or more processor units; and the controlling the underwater drilling component is performed by at least three of the three or more processor units according to a majority voting scheme.

19. The method of claim 14, wherein the underwater drilling component comprises a BOP.

20. The method of claim 14, wherein the removably coupling includes disposing the processor unit at least partially within the volume defined by the receptacle such that the receptacle at least partially encloses the respective processor unit.

21. The method of claim 14, wherein the receptacle is at least partially conical in shape.

22. The method of claim 14, further comprising using an underwater vehicle to at least one of remove the processing unit from the receptacle or insert the processing unit into the volume defined by the receptacle, when both the receptacle and processing unit are underwater.

* * * * *